US009958165B2

(12) United States Patent
Collins et al.

(10) Patent No.: US 9,958,165 B2
(45) Date of Patent: May 1, 2018

(54) HOME APPLIANCE WITH MAINTOP GAS CONTROL APPARATUS

(75) Inventors: Gayle Collins, New Bern, NC (US); James Gayle, New Bern, NC (US); George Savitz, New Bern, NC (US); Charles Weimer, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 1376 days.

(21) Appl. No.: 13/449,339

(22) Filed: Apr. 18, 2012

(65) Prior Publication Data

US 2013/0276909 A1 Oct. 24, 2013

(51) Int. Cl.

| | |
|---|---|
| ***G05D 11/00*** | (2006.01) |
| ***F24C 14/02*** | (2006.01) |
| ***F24C 3/12*** | (2006.01) |

(52) U.S. Cl.

CPC ..... *F24C 14/025* (2013.01); *F24C 3/12* (2013.01); *Y10T 137/2605* (2015.04)

(58) Field of Classification Search

CPC ..... F24C 3/12; F24C 14/025
USPC ..... 126/52; 431/12; 251/77, 129.11, 229
See application file for complete search history.

(56) References Cited

U.S. PATENT DOCUMENTS 3,253,300 A * 5/1966 Gove ..... B01F 7/00758 138/43
5,137,257 A * 8/1992 Tice ..... F16K 31/04 185/40 R
5,655,900 A 8/1997 Cacciatore
5,662,465 A * 9/1997 Kano ..... F23N 5/022 126/19 R
6,003,535 A * 12/1999 Ollivier ..... F16K 31/04 137/8
6,843,243 B2 * 1/2005 Steurer ..... F24C 3/126 126/39 G
6,933,474 B2 8/2005 Sanjay Shukia et al.
7,045,748 B2 5/2006 Blackson et al.
7,479,006 B2 * 1/2009 Newsom ..... F23N 1/00 126/39 N
7,736,144 B2 * 6/2010 Sun ..... F23Q 2/164 431/12

(Continued)

FOREIGN PATENT DOCUMENTS

CN 2924348 Y 7/2007

*Primary Examiner* — Steven B McAllister
*Assistant Examiner* — Rabeeul Zuberi
(74) *Attorney, Agent, or Firm* — Michael E. Tschupp; Andre Pallapies; Brandon G. Braun

(57) ABSTRACT

A home appliance with maintop gas control includes a gas control apparatus including a pressure regulator for receiving gas from a gas facility and distributing gas within the home appliance, the pressure regulator defining a gas conduit having a gas inlet, at least one gas outlet, and a valve disposed intermediate the gas inlet and at least one gas outlet, the valve including a valve stem configured for movement along an axis to open and close the valve; and a valve actuator including a drive element disposed remotely from the valve, the drive element being a rotary drive element operatively engaged with the valve stem for moving the valve between an open position and a closed position; and a mechanical link assembly disposed intermediate the valve stem and the drive element for converting rotary movement of the drive element into linear movement of the valve stem.

22 Claims, 9 Drawing Sheets

(56) References Cited

U.S. PATENT DOCUMENTS

| | | | | |
|---|---|---|---|---|
| 7,740,228 | B2 * | 6/2010 | Simpson | F16K 1/221 251/305 |
| 7,950,384 | B2 * | 5/2011 | Albizuri | F16K 5/0214 126/39 E |
| 8,191,859 | B2 * | 6/2012 | Min | F16D 41/069 251/129.11 |
| 9,038,621 | B2 * | 5/2015 | Cadima | F24C 3/126 126/39 E |
| 2006/0016445 | A1 | 1/2006 | Cadima et al. | |
| 2006/0161185 | A1 * | 7/2006 | Saadat | A61B 17/0469 606/153 |
| 2007/0241296 | A1 * | 10/2007 | Prieto Barranco | F16K 37/0083 251/29 |
| 2008/0017815 | A1 * | 1/2008 | Callahan | F16K 1/221 251/77 |
| 2012/0085952 | A1 * | 4/2012 | Hauk | F16K 31/045 251/129.11 |
| 2012/0125318 | A1 * | 5/2012 | Cadima | F24C 3/12 126/39 R |
| 2014/0202408 | A1 * | 7/2014 | Pluta | F01L 1/181 123/90.15 |

* cited by examiner

HOME APPLIANCE WITH MAINTOP GAS CONTROL APPARATUS

BACKGROUND OF THE INVENTION

The present invention relates broadly to home appliances having apparatus for controlling fuel flow. More particularly, the present invention relates to a home appliance having a gas control apparatus using an automated valve actuator for selectively controlling fuel flow in a self-cleaning gas-fueled range.

A home appliance such as a range, or stove, often includes both a maintop, or cooktop, for surface cooking and an oven for internal baking, broiling and roasting. Often, both the maintop and the oven are fueled by gas which can provide heat more quickly and provide enhanced temperature control when compared to their electrical counterparts.

Gas is routed through the range body with piping and is directed to each of the burners of the maintop as well as each of the burners in the oven. Often, the gas destined for the oven is separated from the maintop gas at a pressure regulator disposed within the range body that receives a gas feed from local facilities and can serve as a distribution center for the gas, directing one stream to the maintop and a separate stream to the oven.

One type of pressure regulator includes a body formed with an input and two outputs, one output for maintop gas and another output for oven gas. The oven gas output portion includes a manually operated valve formed integrally with the regulator body and defining a generally tubular portion on one side of the regulator body. A manual valve operator projects from one end of the tubular portion and the oven gas output is in the opposite end of the tubular portion from the valve operator.

As is generally known for electric ovens, gas ovens can also be configured for self-cleaning, i.e. pyrolytic cleaning, which occurs under high heat, with oven temperatures possibly exceeding 750° F. (about 400° C.). The pyrolysis process usually takes more than an hour and generally reduces the oven contents to ashes that can be easily removed from the oven.

Since the maintop often overlies the oven, the gas delivery to the maintop can often pass between the maintop and the oven body. As may be expected, temperatures immediately adjacent the oven body are often extremely elevated with the internal oven temperature greater than 750° F. Accordingly, it is necessary to provide extensive shielding above the oven to maintain a reasonable temperature at the gas conduits directing gas to the maintop.

From a manufacturing and cost standpoint, it would be desirable to reduce the need for the extensive shielding over the oven in a manner that is both effective and economical.

It is known generally to disable or lock out gas to the maintop in order to alter the thermal requirements in the area above the oven. Others have approached this problem with solutions that can be expensive to incorporate both in manufacturing difficulty and parts expense. In that regard, additional valves have been inserted in the maintop gas conduits within the range. These valves are operable to prevent gas from reaching the area over the oven during self-cleaning. Such approaches address the problem of shielding reduction, yet there remains the problem of doing so while being more economical from both a manufacturing difficulty standpoint and a parts expenditure standpoint.

SUMMARY OF THE INVENTION

The present invention is intended to address the problem set forth above by providing an apparatus to block or stop the flow of gas to the maintop gas delivery conduit during the pyrolysis event.

The present invention is also intended to provide such a gas control apparatus that stops the flow of gas to the maintop at a position in the range remote from the oven temperatures and in a manner that economically utilizes existing structures within the range.

The present invention is intended to provide a solution to the shielding reduction problem in a manner that reduces both manufacturing costs and parts costs over the current approaches to the problem.

The present invention is intended to provide a home appliance having a gas control apparatus that incorporates an existing pressure regulator that is already configured for mounting in the range at a position that is accessible in a straightforward manner from outside the oven for both installation and repair.

To those ends, a home appliance fueled at least partially by gas includes a gas control apparatus. The gas control apparatus includes a pressure regulator for receiving gas from a gas facility and distributing gas within the home appliance as fuel for heating use. The pressure regulator defines a gas conduit having a gas inlet and at least one gas outlet, and a valve disposed intermediate the gas inlet and the at least one gas outlet. The valve includes a valve stem configured for movement along an axis to open and close the valve.

The gas control apparatus further includes a valve actuator including a drive element disposed remotely from the valve. The drive element is a rotary drive element operatively engaged with the valve stem for moving the valve between an open position and a closed position. The valve actuator further includes a mechanical link assembly disposed intermediate the valve stem and the drive element for converting rotary movement of the drive element into linear movement of the valve stem.

The mechanical link assembly preferably includes a first link having a rigid body attached to the drive element for rotational movement therewith; and a second link having a flexible body portion. The second link is preferably flexibly attached to the first link and flexibly attached to the valve stem for inducing linear movement of the valve stem responsive to movement of the first link. The second link accommodates off-axis movement of the first link while maintaining axial movement of the valve stem during movement of the valve between the open position and the closed position.

It is preferred that the regulator is initially configured with an oven gas outlet and a maintop gas outlet with the valve being operatively associated with the oven gas outlet. The regulator is reconfigured with the valve being operatively associated with the maintop gas outlet. In this manner, the present invention utilizes an existing range part for operational support and locates the valve adjacent the main gas entry point of the range.

Preferably, the second link is formed as a coil spring. It is further preferred that the present invention include a third link flexibly attached to the first link and flexibly attached to the second link. The third link may be formed as a rigid arm member.

The present invention also preferably includes a switch operatively associated with the drive element for enabling a signal responsive to valve actuator action. The switch may include a switch body and a switch operator, wherein the switch operator projects outwardly from the switch body. The first link may be formed with a camming surface for selective engagement with the switch operator to enable a signal representative of valve position.

It is preferable that the drive element is an electric motor configured for partial revolution operation, wherein the motor is configured to turn a partial revolution in a first direction to close the valve and the motor is configured to turn a partial revolution in a second direction, different from the first direction, to open the valve. The partial revolution may be on the order of a quarter-turn.

Preferably, the gas control apparatus includes a controller for generating and transmitting a signal to the drive element to operate the valve. Many ranges utilize electronic controllers to govern cooking and cleaning operations. Control of the present gas control apparatus can be programmed into such an electronic controller for automated control of fuel delivery to the maintop.

The present invention is also directed to a range. To that end, a self-cleaning gas-fueled range includes a range body, a maintop mounted to the range body, with the maintop having at least one gas burner. An oven is mounted within the range body, with the oven having at least one gas burner. A gas control apparatus is also included. The gas control apparatus includes a pressure regulator for receiving gas from a gas facility and distributing gas within the home appliance as fuel for heating use. The pressure regulator defines a gas conduit having a gas inlet and at least one gas outlet. A valve is disposed intermediate the gas inlet and the at least one gas outlet, with the valve including a valve stem configured for movement along an axis to open and close the valve. The gas control apparatus also includes a valve actuator including a drive element disposed remotely from the valve. The drive element is a rotary drive element operatively engaged with the valve stem for moving the valve between an open position and a closed position. The valve actuator further includes a mechanical link assembly disposed intermediate the valve stem and the drive element for converting rotary movement of the drive element into linear movement of the valve stem.

Preferably, the mechanical link assembly includes a first link having a rigid body attached to the drive element for rotational movement therewith and a second link having a flexible body portion. The second link is flexibly attached to the first link and flexibly attached to the valve stem for inducing linear movement of the valve stem responsive to movement of the first link. The second link accommodates off-axis movement of the first link while maintaining axial movement of the valve stem during movement of the valve between the open position and the closed position.

It is further preferred that the regulator is initially configured with an oven gas outlet and a maintop gas outlet with the valve being operatively associated with the oven gas outlet. Preferably, the regulator is reconfigured with the valve being operatively associated with the maintop gas outlet.

Preferably, the second link is formed as a coil spring. It is further preferred that the present invention include a third link flexibly attached to the first link and flexibly attached to the second link. The third link may be formed as a rigid arm member.

The self-cleaning gas-fueled range preferably further includes a switch operatively associated with the valve actuator for enabling a signal responsive to valve actuator action. The switch may include a switch body and a switch operator. The switch operator projects outwardly from the switch body and the first link is formed with a camming surface for selective engagement with the switch operator to enable a signal representative of valve position.

It is preferred that the drive element is an electric motor configured for partial revolution operation. The motor is configured to turn a partial revolution in a first direction to close the valve and the motor is configured to turn a partial revolution in a second direction, different from the first direction, to open the valve.

As is also discussed above, the present invention may further include a controller for generating and transmitting a signal to the drive element to operate the valve. The controller is configured to transmit a signal to the motor to close the valve whenever a self-cleaning mode is entered. The controller is also configured to receive a signal enabled by the switch to indicate that the valve is closed and, in response, transmit a signal to illuminate lamp to indicate to a user that the valve is closed and gas is prevented from reaching the maintop.

By the above the present invention provides the ability to reduce shielding between the oven and maintop gas delivery conduits while utilizing a preexisting pressure regulator in an unexpected and effective manner to provide a cutoff or lockout for gas delivered to the maintop in a manner that reduces the manufacturing costs and the parts costs associated with other approaches to the problem. In doing so, the present invention provides an automated maintop gas cutoff valve for use during oven self-cleaning that is effective and economical to implement, while providing smooth valve operation and longer valve life.

DESCRIPTION OF THE PREFERRED EMBODIMENTS

Figure 1:
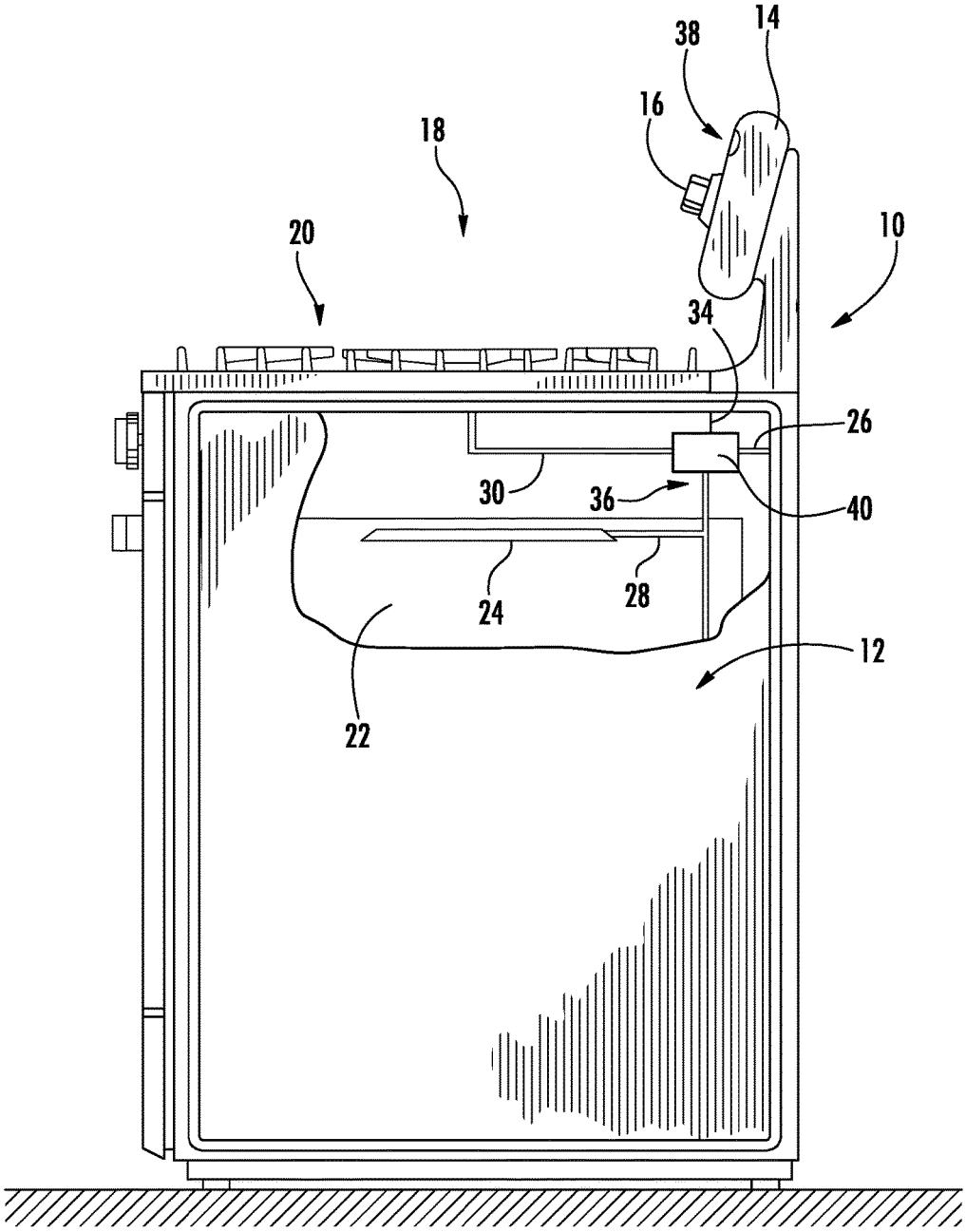
FIG. 1 is a side view of a gas range broken open to diagrammatically illustrate a gas distribution system in a home appliance, particularly a range, incorporating a maintop gas control apparatus according to a preferred embodiment of the present invention.

Turning now to the drawings, and, more particularly, to FIG. 1, a home appliance, in this case a range, is illustrated at 10. The range 10 includes a paneled body 12 having an oven 22 having at least one burner 24 disposed therein, and a maintop 18, including a number of burners 20, disposed thereon. A gas control apparatus 40 is disposed adjacent a rear portion of the range 10. It should be understood that the range 10 is depicted diagrammatically internally and the components may be not be realistically depicted or depicted to scale.

A gas line in 26 enters the gas control apparatus 40 from gas facilities, be it line or tank, outside the range 10. From there, gas conduits 36 receive and distribute the gas. The gas delivery is split into a first gas line 30 directing gas to the burners 20 of the maintop 18 and a second gas line 28 directing gas to the burners 24 of the oven 22. As can be seen, the gas line 30 directed to the burners 20 is extended over the oven 22 and a first oven burner 24. This is the area in which a shielding reduction is made possible by the present invention.

User-operable controls 16 are provided on a console 14 for controlling range operation including oven operation which includes pyrolytic cleaning. Electric wiring 34 provides communication between the controls 16 and the gas control apparatus 40 of the present invention. Additionally, an indicator light, or lamp 38 is provided on the console 16 to indicate that gas is either available for the maintop or is shut off due to operation of the gas control apparatus 40. Further, the indicator light at 38 may be accompanied by an audible warning.

It should be noted that the gas control apparatus 40 of the present invention is not operably engaged with user operable throttle controls that adjust the flame for cooking operations. However, when the present gas control apparatus 40 has stopped gas to the maintop 18, such user operable throttle controls are ineffective by virtue of gas deprivation caused by the present gas control apparatus 40 shutting off gas to the maintop 18 and associated burners 20.

Figure 2:
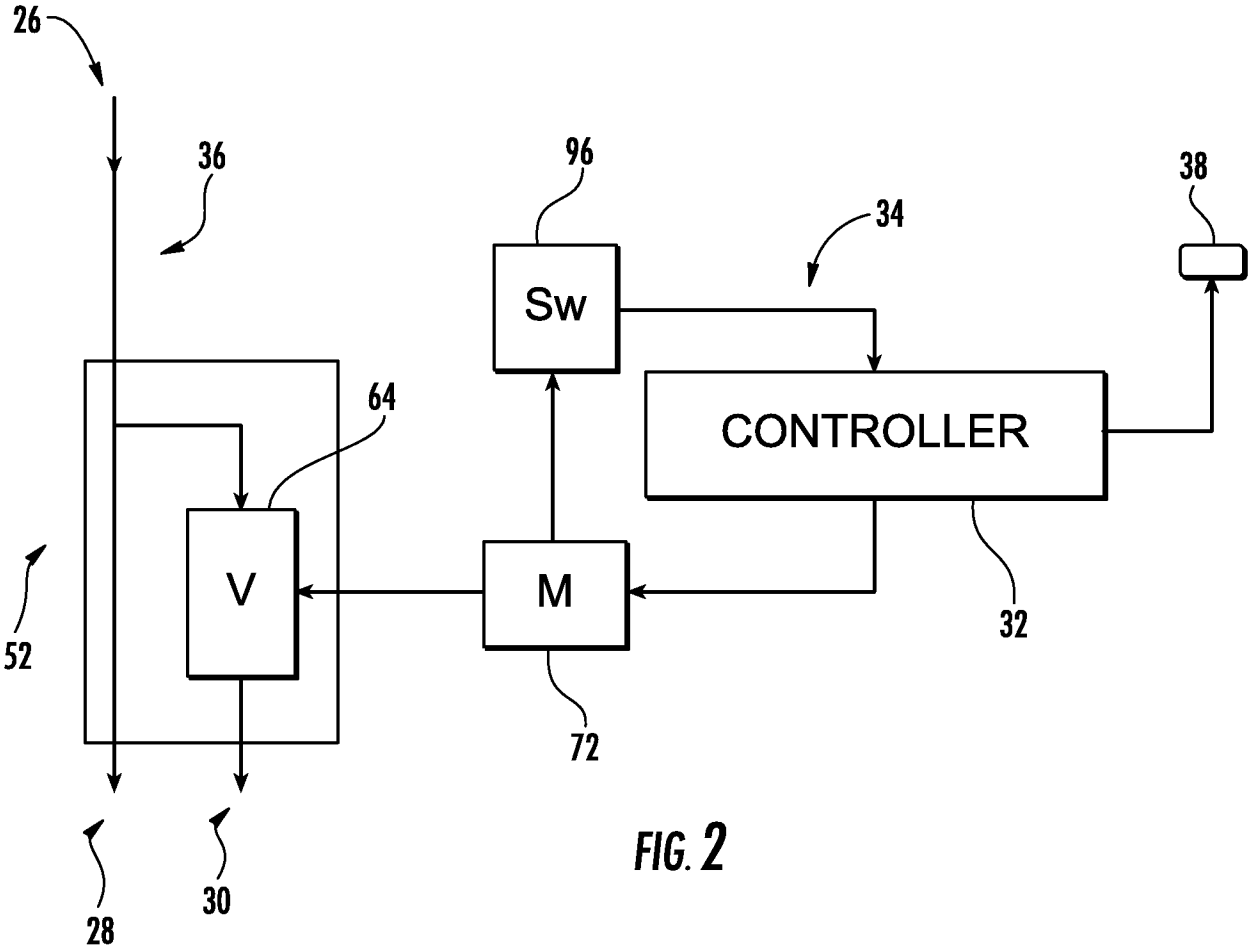
FIG. 2 is a block diagram of the gas control apparatus illustrated in FIG. 1.

The gas control apparatus 40 of the present invention and its operational relationship to the range 10 are illustrated in block-diagram form in FIG. 2. There, gas is directed from an inlet 26 through gas conduits 36 to a pressure regulator 52. The pressure regulator 52, among other activities, directs gas outwardly to the oven through an outlet 28 and to the maintop through an outlet 30. A valve 64 is disposed intermediate the gas inlet 26 and the outlet 30 to the maintop within the pressure regulator 52 to control gas flow to the maintop 18, as seen in FIG. 1.

According to one aspect of the present invention, a certain type of pressure regulator 52 can be used for enhanced cost savings. To that end, a conventional pressure regulator having one gas inlet and two gas outlets can include a first gas outlet directed to the maintop and a second gas outlet directed to the oven. The valve is associated with the oven gas outlet. Such a pressure regulator can be reconfigured in a straightforward manner to be a part of the present invention to thereby provide enhanced cost savings. When using such a pressure regulator, the oven gas line and maintop gas line are reversed to the configuration discussed above wherein the valve is associated with the maintop gas line and the oven gas line is not associated with the valve.

With reference to FIG. 2, the valve 64 is operable using a motor 72. The motor 72 also operates a switch 96. A controller 32 is in electrical communication with the switch 96 and the motor 72 via electrical wiring 34. The controller 32 is configured to, among other things, send a signal to the motor 72 for valve operation. The controller 32 also receives a signal from the switch 96 to indicate that the motor 72 has been activated to operate the valve 64. The controller 32 sends a signal to the indicator light 38 to indicate to user that the valve 64 is closed and therefore gas in unavailable to the maintop. A more detailed discussion of the pressure regulator 52, motor 72, and switch 96 will be provided hereinafter.

As discussed further herein, the present gas control apparatus 40 is provided for automated cutoff of gas delivery to the maintop primarily for use during self-clean operations. It is further contemplated that the gas control apparatus will be selectively operable apart from the self-cleaning operation for selective cutoff of gas delivery to the maintop for repair and maintenance purposes.

Figure 3:
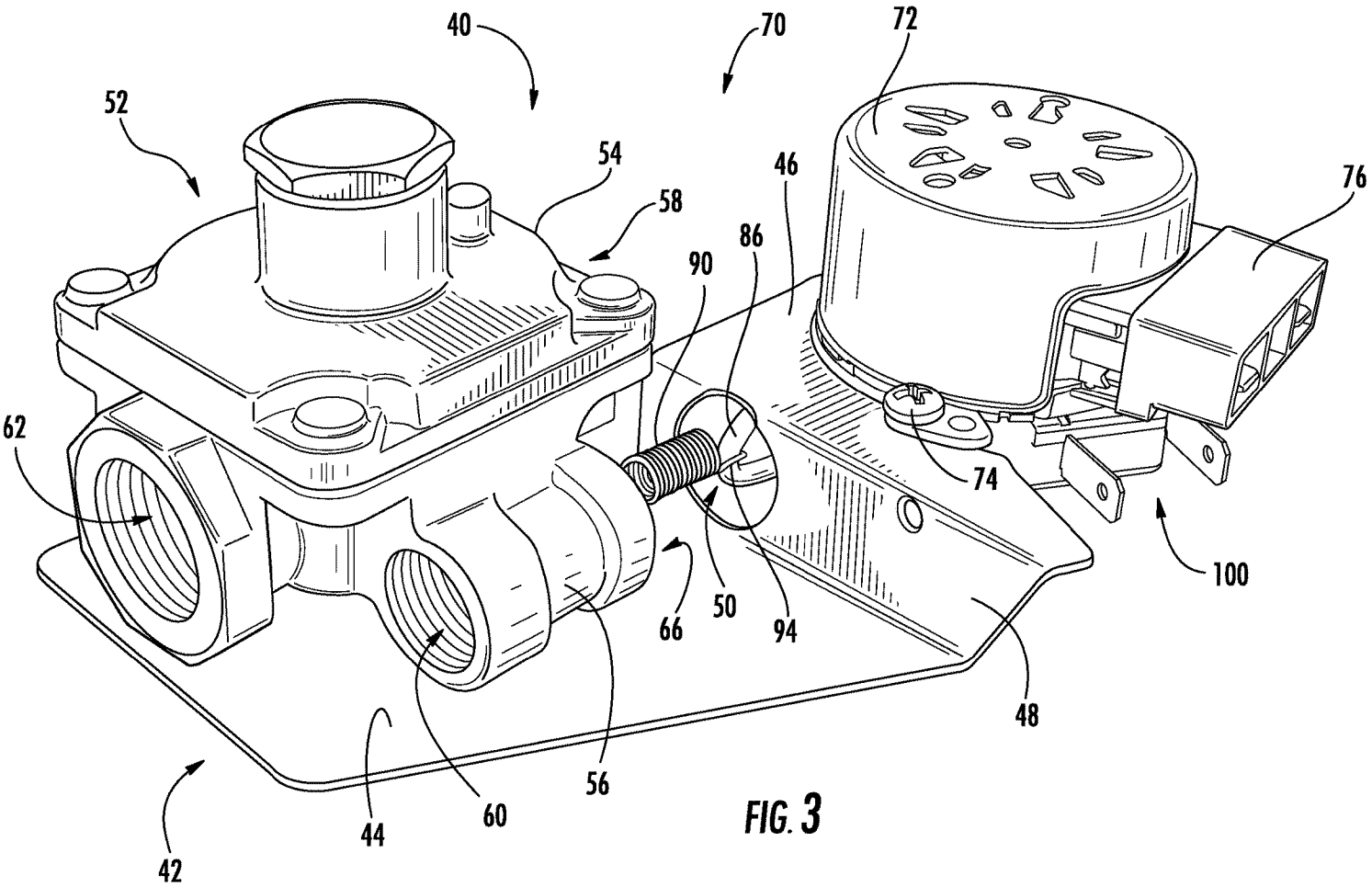
FIG. 3 is a perspective view of a gas control apparatus according to one preferred embodiment of the present invention.

Turning now to FIG. 3, the gas control apparatus is illustrated generally at 40 and includes the pressure regulator 52 and the motor 72 mounted to a bi-level bracket 42. The bracket 42 includes a first platform 44 at a first height and a second platform 46 at a second height with both platforms 44, 46 being substantially planar. The platforms 44, 46 are separated and attached to one another by a vertical wall 48. As will be explained in greater detail hereinafter, an access opening 50 is formed in the vertical wall 48 in support of a valve actuator apparatus, illustrated generally at 70. The bracket 42 is configured for mounting internally within a range near a gas access area for receiving gas from local facilities.

Figure 4:
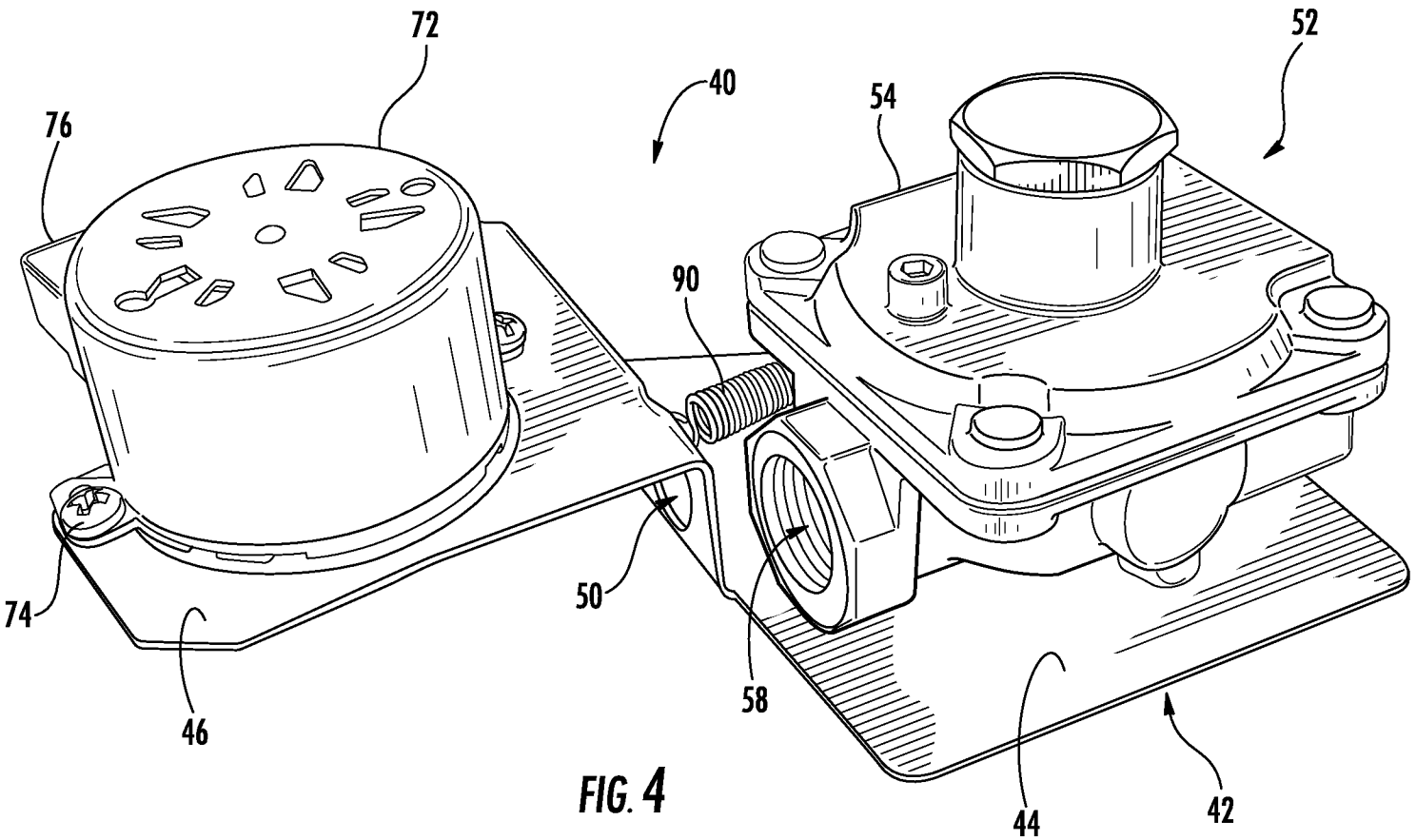
FIG. 4 is a rear perspective view of the gas control apparatus illustrated in FIG. 3.
Figure 6:
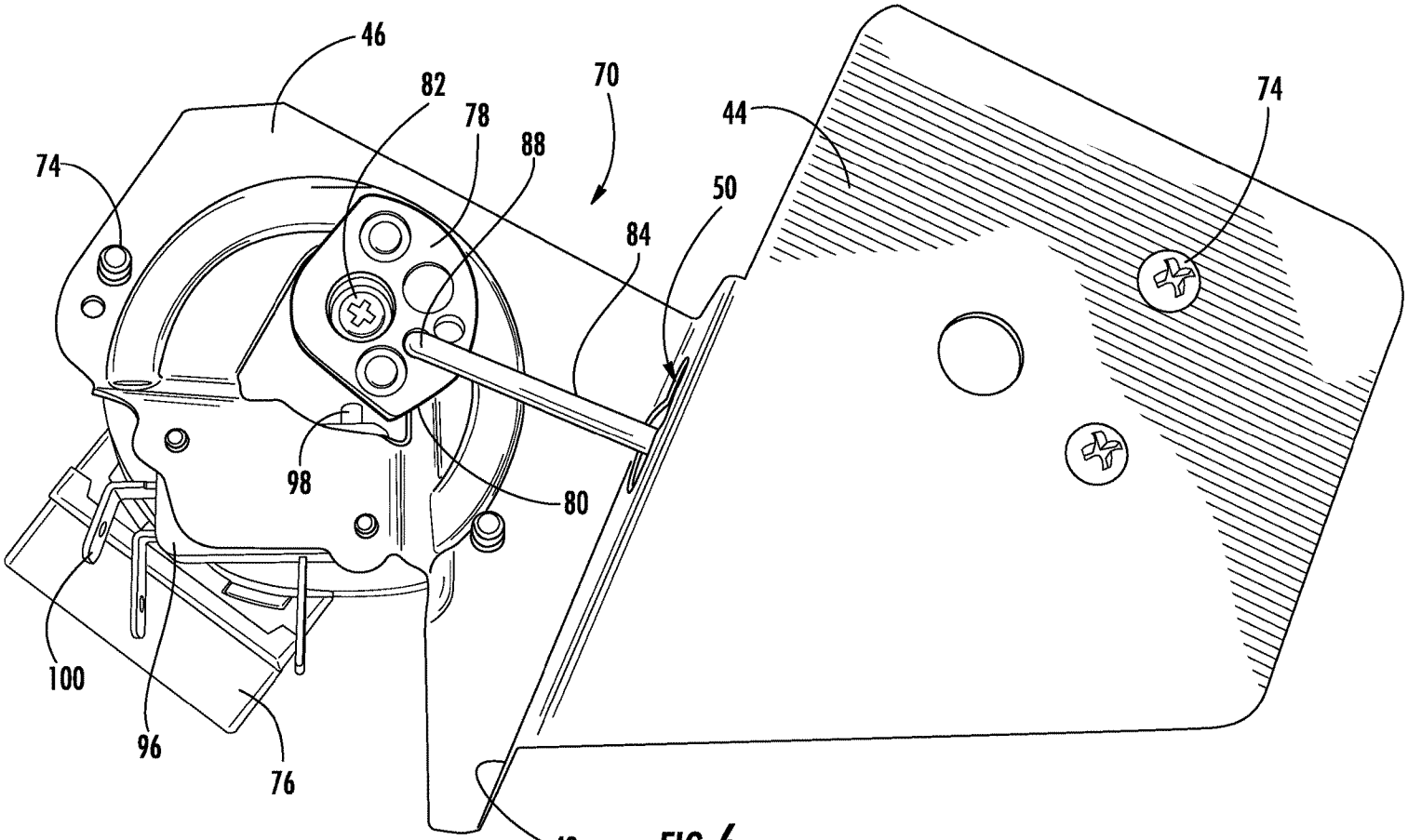
FIG. 6 is a bottom plan view of the gas control apparatus illustrated in FIG. 3.

The gas pressure regulator 52 is mounted to the first platform 44 using conventional fasteners 74, which may be screws, as seen in FIG. 6. As seen in FIG. 3 and FIG. 4, the pressure regulator 52 includes a generally square regulator body 54 having a gas inlet 58 and two gas outlets 60, 62 formed therein. The gas inlet 58 receives gas from a gas supply facility (not shown) outside the range and is formed on one end of the regulator body 54. A tubular portion is formed integrally with the regulator body 54 on a side thereof and forms a gas conduit 56 that includes a first gas outlet 60 that directs gas to the maintop. A second gas outlet 62 disposed adjacent the first gas outlet 60 directs gas to the oven.

Figure 5:
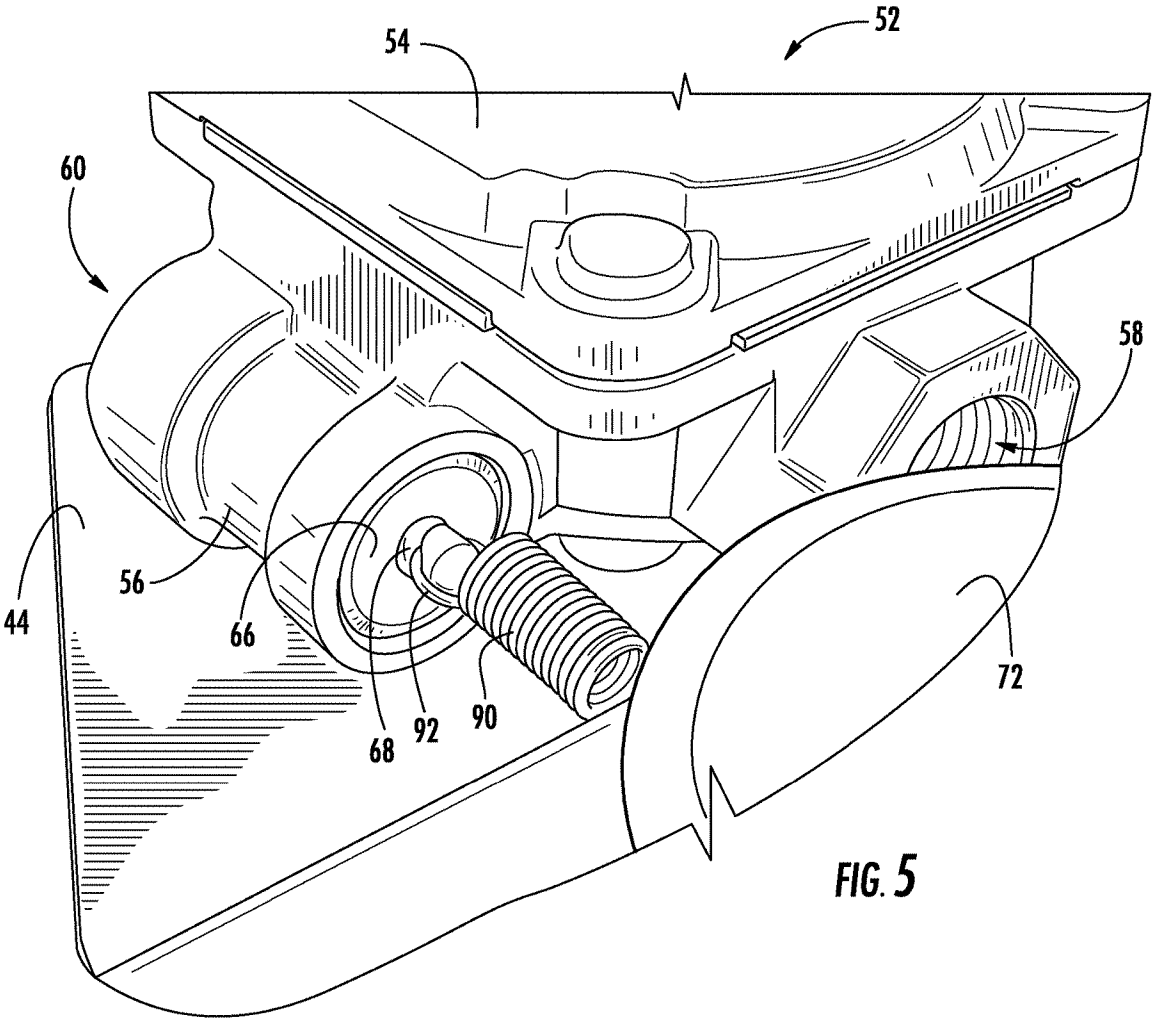
FIG. 5 is a perspective view of the pressure regulator area of the gas control apparatus illustrated in FIG. 3.

The valve 64 is disposed within the conduit 56 to control gas access to the first gas outlet 60 by being operable to move between an open position and a closed position. The valve 64, being contained within the conduit 56, is not shown in FIG. 3, but is illustrated in the block diagram of FIG. 2. With reference to FIG. 5, the valve 64 includes a moveable valve stem 68 which is fitted within the conduit 56 with the valve stem 68 projecting through an aperture in a valve body or cover 66 for axial movement along a linear axis defined by the conduit 56. It will be understood by those skilled in the art that reciprocation of the valve stem 68 will open and close the valve 64. The valve stem 68 projects outwardly from the valve body 66 for connection to a valve actuator component as will be explained in greater detail hereinafter.

As seen in FIGS. 3 and 6, a value actuator 70 is provided in order selectively move the valve 64 from an open position to a closed position in the event of pyrolytic oven cleaning. The valve actuator 70 includes several components including an electric motor 72 operable as a drive element. The motor 72 includes an electrical connector 76 and is mounted to the second platform 46 using fasteners 74, which are conventional screws in the present case.

The motor 72 is an electric motor configured to move its armature through one partial revolution, in the present case approximately a quarter-turn, in either direction depending on excitation of the motor 72. A mechanical link assembly is provided in order to convert rotary motion of the motor armature into linear motion of the valve stem 68, and includes, with reference to FIG. 6, a rigid link in the form of a quarter-disk cam 78 attached to the motor 72 using a screw 82. As will be explained in greater detail hereinafter, the cam 78 includes a camming surface 80 formed on a lateral edge thereof.

An arm 84 projects away from the cam 78 and is flexibly mounted thereto using an arm hook 88 loosely fitted in an aperture formed in the cam 48. The arm 84 passes through the access opening 50 in the vertical wall 48. Movement of the cam 78 moves the arm 84 between a position in general alignment with the valve stem axis and a position wherein the arm 84 is skewed into an off-axis or offset position while operating the valve 64.

Figure 7:
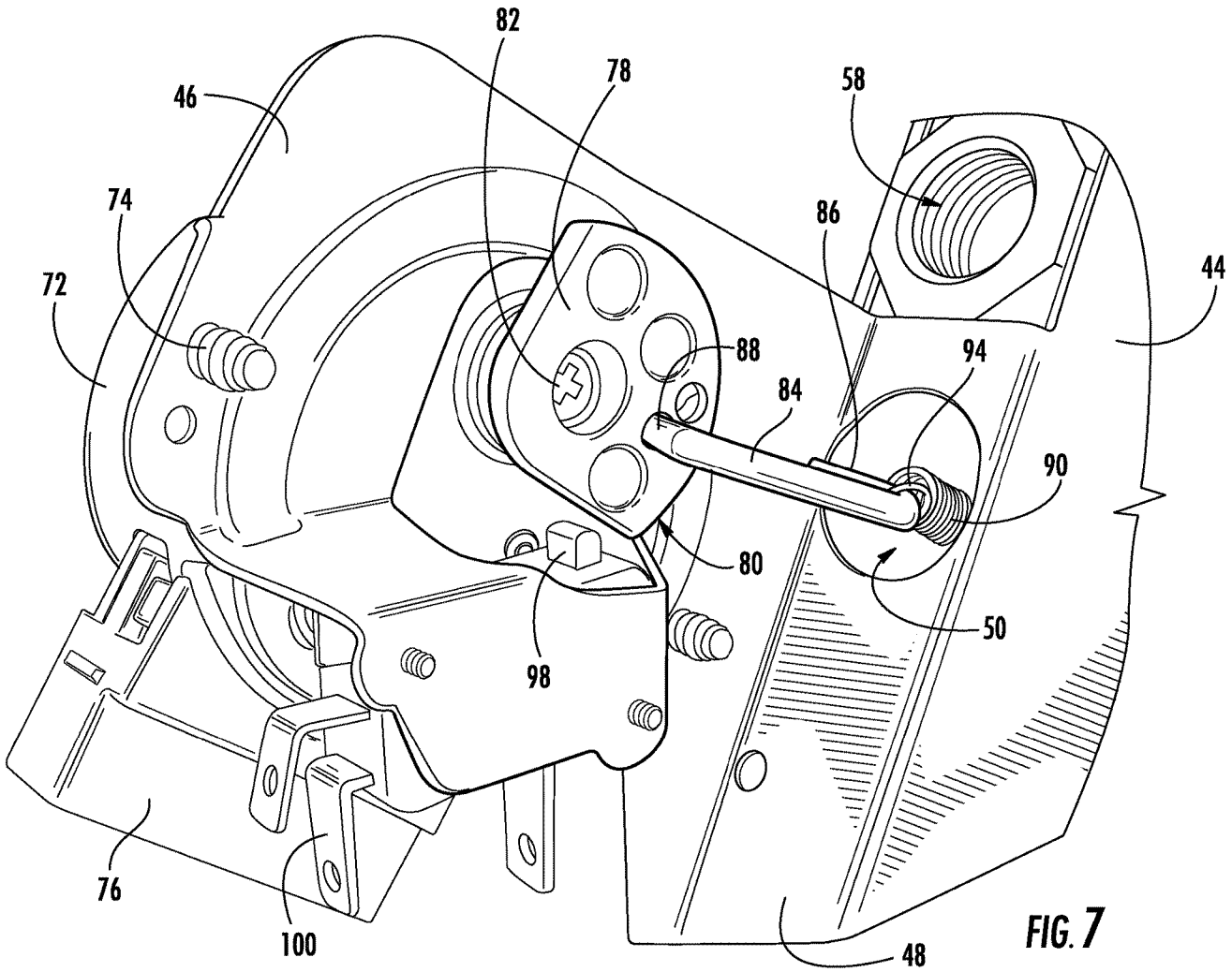
FIG. 7 is a bottom perspective view of the gas control apparatus at a valve open position according to one preferred embodiment of the present invention.

With reference to FIG. 5, a coil spring 90 is flexibly attached to the valve stem 68 using a spring hook 92 formed on the spring 90. With reference to FIG. 3 and FIG. 7, the other end of the spring 90 includes a second hook 94 that is flexibly attached to a second arm hook 86. The spring flexible coil accommodates the movement of the cam 78 and arm 84 into the offset position. Along with the flexible mounting structure, the spring coil eases the impact of any lateral force exerted on the valve stem 68 during operation of the valve actuator 70, as well as dampening any jerk force resulting from motor 72 start-up.

With the above configuration, rotation of the cam 78 in clockwise direction as driven by the motor 72 draws the arm 84 away from the valve body 66 and exerts a force on the spring 90 which in turn transmits the force to the valve stem 68 thereby moving the valve stem 68 along with the valve 64 linearly along the axis in the general direction of the motor 72, thereby closing the valve 64.

Figure 9:
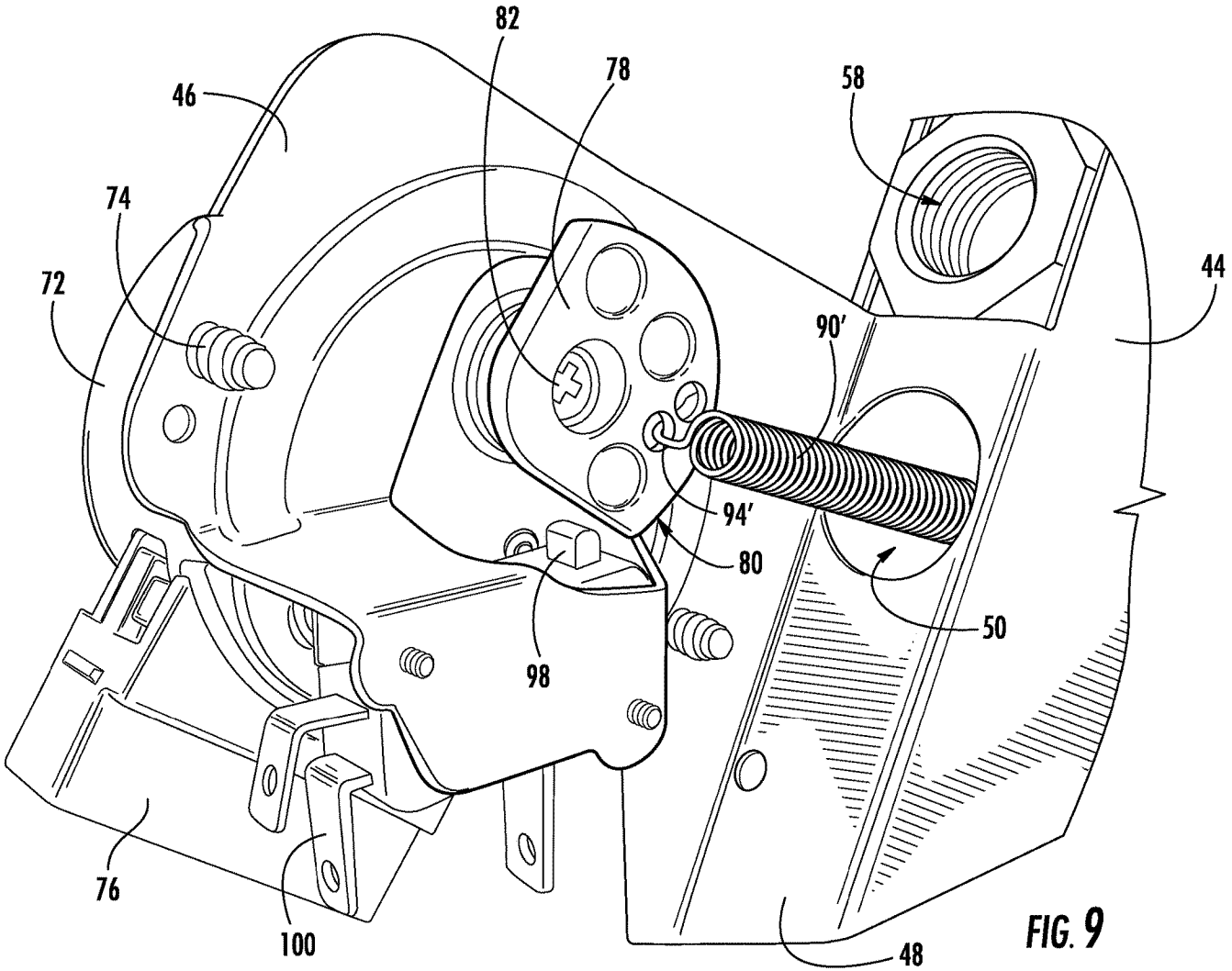
FIG. 9 is a bottom perspective view of a gas control apparatus according to a second preferred embodiment of the present invention.

An alternate embodiment of the present invention is illustrated in FIG. 9. There, the arm 84 and spring 90 are replaced by an elongate, i.e. longer, spring 90' with the spring hook 94' flexibly mated with the cam 78 in a manner as described above.

Figure 8:
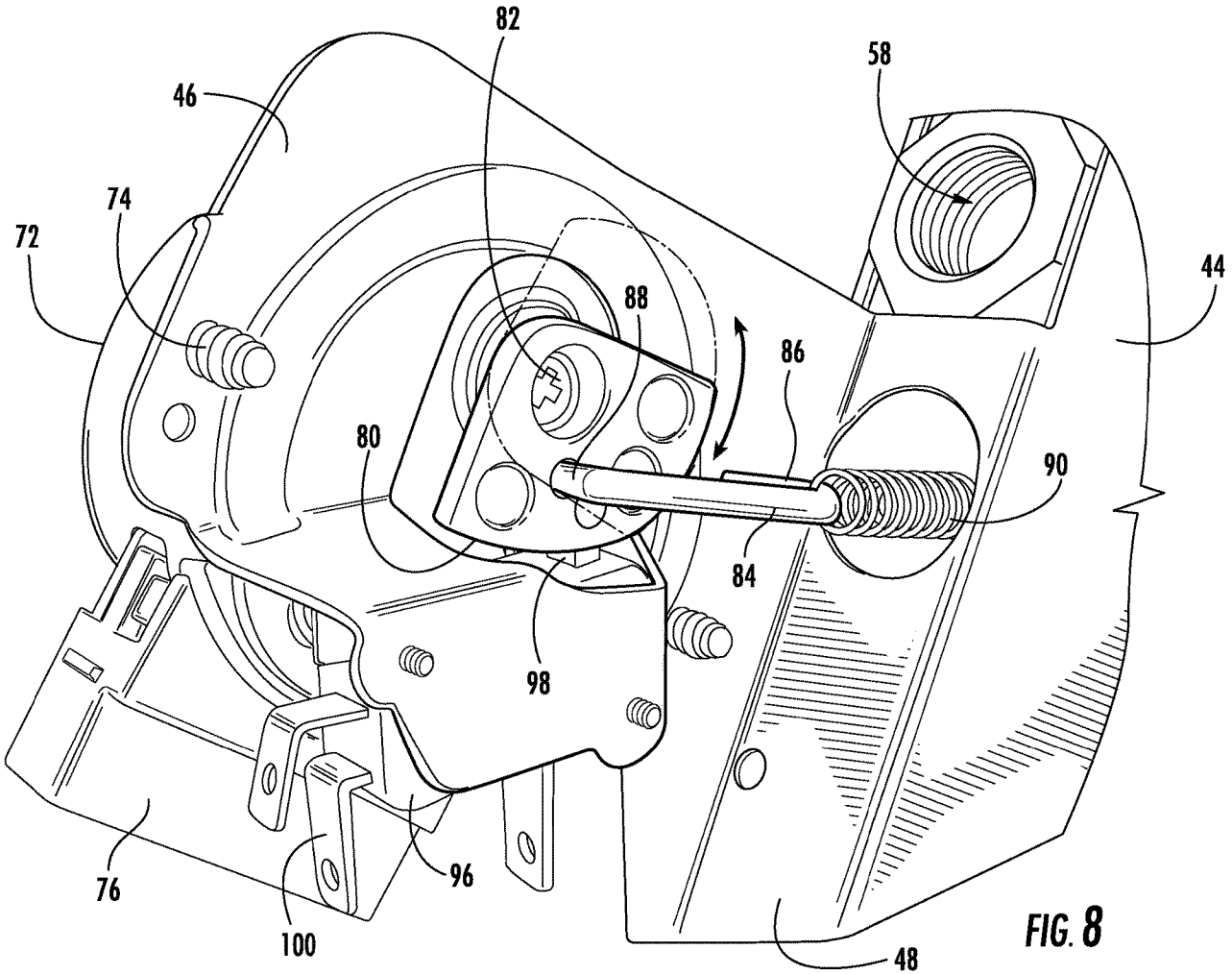
FIG. 8 is a perspective view of the gas control apparatus at a valve closed position according to the preferred embodiment illustrated in FIG. 7.

The spring 90 plays an important role in the valve actuator 70 operation. As seen in FIG. 7 and FIG. 8, the cam 78 moves the arm 84/spring 90 combination or, in the case of FIG. 9, the spring 90', off axis with the respect to the valve stem 68 as seen in FIG. 5 and FIG. 8. The flexible configuration of the spring 90 as well as the flexible mounting of the various hooks 86, 88, 92, 94 allow lateral flexibility such that the force closing and opening the valve 64 transmitted through the spring 90 and the arm 84 based on the torque of the motor 72 in the off-axis direction is reduced so that the valve 64 is not put in a bind and is allowed to operate more freely. Further, and as stated elsewhere herein, the spring acts as a dampener, dampening any jerk force resulting from motor 72 start-up As seen in FIG. 8, the switch 96 is mounted to the second platform 46 adjacent the motor 72 and is connected to the control system of the range using electrical connectors 100, in order to provide an indication to the user that the maintop gas is unavailable, and to provide feedback to the controller 32 that the motor 72 has indeed turned a quarter-turn to close the valve, as referenced above with respect to FIG. 2. A push-button type switch operator 98 projects outwardly from the switch 96 into the motion path of the camming surface 80 of the cam 78. With the valve open, the cam 78 is in the position illustrated in FIG. 7 with the switch operator 98 fully extended.

With reference to FIG. 8, when the motor 72 is activated to close the valve, the cam 78 moves through its quarter-turn clockwise with the arm 84 moving and exerting a pulling force on the spring 90, and the camming surface 80 engaging and depressing the switch operator 98 thereby closing the circuit to provide a signal for use by the controller 32, as seen in FIG. 2, indicating that the valve 64 is closed.

In operation, and with reference to FIGS. 2, 7 and 8, the pre-programmed controller 32 generates a signal for a motor 72 to operate the valve 64 to commence valve closure. The controller 32 may operate the gas control apparatus 40 based on a number of indicators that a pyrolysis event is starting. For example, if a user uses the control 86 to select self-clean, the controller 32 may receive a signal from there and activate the motor 72. Additionally, self-cleaning ovens typically include a latch to latch the oven door in a closed position to prevent access during self-cleaning. The controller 32 may also receive a signal from the latch indicating that pyrolysis is about to commence.

To close the valve 64, the motor 72 is energized and the cam 78 is rotated clockwise through approximately a quarter-turn, starting at the position illustrated in FIG. 7 and ending at the position illustrated in FIG. 8. In doing so, the cam moves the arm 84 and the spring 90 linearly and laterally away from the valve body 66 (see FIG. 5) and therefore pulls the valve stem 68 to close the valve 64. The motor 72 also mechanically operates the switch 96, using the camming surface 80 in contact with the switch operator 98 to drive the switch operator 98 inwardly and thusly close the switch 96, which in turn enables an electric signal over wiring 34 directed to the controller 32 indicating that the valve 64 is closed. Once the valve 64 is closed, the controller 32 transmits a signal to the indicator 78 indicating that the valve is closed and that no gas is available for the maintop during self-cleaning.

Once the self-cleaning operation has finished, the controller 72 sends a signal to the motor 72 that self-cleaning has ended and that the valve 64 is to be opened. The operational signal from the controller 32 excites the motor 72 to move generally a quarter-turn counter-clockwise, starting at the position illustrated in FIG. 8 and ending at the position illustrated in FIG. 7. During this motion, force is applied to the arm 84 in the opposite direction as before, i.e., a "pushing" force, which works with the spring 90 bias to close the valve 64. Once the camming surface 80 is away from the switch operator 98, the switch 96 is open, with the signal from the switch to the controller 32 going to an off state. The controller 32 then signals the indicator 78 that the valve is open and the indicator provides such information to a user that the valve 64 is open and gas is once again available to the maintop.

Based on the forgoing, the present invention provides an effective and inexpensive solution to allow reduced shielding between the oven and gas conduits directed to the maintop of a range. By using existing parts where possible, the present invention provides an apparatus that is efficient from both a manufacturing standpoint and a parts expense standpoint.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance fueled at least partially by gas, the home appliance comprising:

a gas control apparatus including:

a pressure regulator for receiving gas from a gas facility and distributing gas within the home appliance as fuel for heating use, the pressure regulator defining a gas conduit having a gas inlet, at least one gas outlet, and a valve disposed intermediate the gas inlet and the at least one gas outlet, the valve including a valve stem configured for movement along an axis to open and close the valve; and a valve actuator including a drive element disposed remotely from the valve, the drive element being a rotary drive element operatively engaged with the valve stem for moving the valve between an open position and a closed position; and a mechanical link assembly disposed intermediate the valve stem and the drive element for converting rotary movement of the drive element into linear movement of the valve stem, the mechanical link assembly having a first link having a rigid body attached to the drive element for rotational movement therewith; and a second link having a flexible body portion, the second link being flexibly attached to the first link and flexibly attached to the valve stem for inducing linear movement of the valve stem responsive to movement of the first link, the second link facilitating off-axis movement, relative to the valve stem, of the first link while maintaining axial movement of the valve stem during movement of the valve between the open position and the closed position, such that the second link translates the rotational movement of the first link to the linear movement of the valve stem.

2. A home appliance according to claim 1 wherein the second link has a laterally flexible body portion.

3. A home appliance according to claim 1 wherein the regulator is initially configured with an oven gas outlet and a maintop gas outlet with the valve being operatively associated with the oven gas outlet and wherein the regulator is reconfigured with the valve being operatively associated with the maintop gas outlet.

4. A home appliance according to claim 2 wherein the second link is formed as a coil spring flexibly attached to the valve stem and the first link for lateral movement with respect to the valve stem and the first link.

5. A home appliance according to claim 3 and further comprising a third link flexibly attached to the first link and flexibly attached to the second link.

6. A home appliance according to claim 5 wherein the third link is formed as a rigid arm member.

7. A home appliance according to claim 1 and further comprising a switch operatively associated with the drive element for enabling a signal responsive to valve actuator action.

8. A home appliance according to claim 7 wherein the switch includes a switch body and a switch operator, wherein the switch operator projects outwardly from the switch body and the first link is formed with a camming surface for selective engagement with the switch operator to selectively enable a signal representative of valve position.

9. A home appliance according to claim 1 wherein the drive element is an electric motor configured for partial revolution operation, wherein the motor is configured to turn a partial revolution in a first direction to close the valve and the motor is configured to turn a partial revolution in a second direction different from the first direction to open the valve.

10. A home appliance according to claim 1 and further comprising a controller for generating and transmitting a signal to the drive element to operate the valve.

11. A self-cleaning gas-fueled range comprising:

a range body;

a maintop mounted to the range body, the maintop having at least one gas burner;

an oven mounted within the range body, the oven having at least one gas burner; and a gas control apparatus including:

a pressure regulator for receiving gas from a gas facility and distributing gas within the home appliance as fuel for heating use, the pressure regulator defining a gas conduit having a gas inlet, at least one gas outlet, and a valve disposed intermediate the gas inlet and the at least one gas outlet, the valve including a valve stem configured for movement along an axis to open and close the valve; and a valve actuator including a drive element disposed remotely from the valve, the drive element being a rotary drive element operatively engaged with the valve stem for moving the valve between an open position and a closed position; and a mechanical link assembly disposed intermediate the valve stem and the drive element for converting rotary movement of the drive element into linear movement of the valve stem, the mechanical link assembly having a first link having a rigid body attached to the drive element for rotational movement therewith; and a second link having a flexible body portion, the second link being flexibly attached to the first link and flexibly attached to the valve stem using a spring hook formed on the second link, the flexible attachment configured to induce linear movement of the valve stem responsive to movement of the first link, the second link facilitating off-axis movement, relative to the valve stem, of the first link while maintaining axial movement of the valve stem during movement of the valve between the open position and the closed position, such that the second link translates the rotational movement of the first link to the linear movement of the valve stem.

12. A self-cleaning gas-fueled range according to claim 11 wherein the second link has a laterally flexible body portion.

13. A self-cleaning gas-fueled range according to claim 12 wherein the second link is formed as a coil spring flexibly attached to the valve stem and the first link for lateral movement with respect to the valve stem and the first link.

14. A self-cleaning gas-fueled range according to claim 12 and further comprising a third link flexibly attached to the first link and flexibly attached to the second link.

15. A self-cleaning gas-fueled range according to claim 14 wherein the third link is formed as a rigid arm member.

16. A self-cleaning gas-fueled range according to claim 11 and further comprising a switch operatively associated with the valve actuator for enabling a signal responsive to valve actuator action.

17. A self-cleaning gas-fueled range according to claim 16 wherein the switch includes a switch body and a switch operator, wherein the switch operator projects outwardly from the switch body and the first link is formed with a camming surface for selective engagement with the switch operator to selectively enable a signal representative of valve position.

18. A self-cleaning gas-fueled range according to claim 11 wherein the motor is an electric motor configured for partial revolution operation, wherein the motor is configured to turn a partial revolution in a first direction to close the valve and the motor is configured to turn a partial revolution in a second direction different from the first direction to open the valve.

19. A self-cleaning gas-fueled range according to claim 11 and further comprising a controller for generating and transmitting a signal to the drive element to operate the valve.

20. A self-cleaning gas-fueled range according to claim 19 wherein the controller is configured to transmit a signal to the motor to close the valve whenever a self-cleaning mode is entered.

21. A self-cleaning gas-fueled range according to claim 19 wherein the controller is configured to receive a signal enabled by the switch to indicate that the valve is closed and, in response, transmit a signal to illuminate a lamp to indicate to a user that the valve is closed and gas is prevented from reaching the maintop.

22. A home appliance according to claim 1, wherein the drive element is a cam.

* * * * *